US006860616B2

(12) United States Patent
Yu et al.

(10) Patent No.: US 6,860,616 B2
(45) Date of Patent: Mar. 1, 2005

(54) ULTRAVIOLET LIGHT WRITING SYSTEM

(75) Inventors: Sun Yu, Berkley, MI (US); Andrew Tiefel, South Lyon, MI (US); David Perrin, Troy, MI (US)

(73) Assignee: IQ Hong Kong, Ltd., Tsuen Wan (HK)

( * ) Notice: Subject to any disclaimer, the term of this patent is extended or adjusted under 35 U.S.C. 154(b) by 58 days.

(21) Appl. No.: 10/264,993

(22) Filed: Oct. 4, 2002

(65) Prior Publication Data

US 2003/0112623 A1 Jun. 19, 2003

Related U.S. Application Data

(60) Provisional application No. 60/341,434, filed on Dec. 14, 2001.

(51) Int. Cl.[7] ..... B43K 29/10

(52) U.S. Cl. ..... 362/118; 362/84; 362/579; 362/800

(58) Field of Search ..... 362/118, 84, 99, 362/116, 120, 396, 194, 800, 579

(56) References Cited

U.S. PATENT DOCUMENTS

| | | | | |
|---|---|---|---|---|
| 2,663,791 A | | 12/1953 | Hettrick | 240/6.46 |
| 2,811,632 A | | 10/1957 | Bartlett | 240/6.46 |
| 3,045,111 A | | 7/1962 | Hoenig | 240/6.46 |
| 3,303,337 A | | 2/1967 | Lo | 240/6.46 |
| 4,016,414 A | | 4/1977 | Browning et al. | 240/6.46 |
| 4,890,204 A | | 12/1989 | Lin et al. | 362/118 |
| 5,131,775 A | | 7/1992 | Chen | 401/195 |
| 5,448,459 A | * | 9/1995 | Rogers | 362/191 |
| 5,673,996 A | | 10/1997 | Ducker | 362/118 |
| 6,099,185 A | | 8/2000 | Huang et al. | 401/195 |
| 6,164,856 A | | 12/2000 | Lo | 401/52 |
| 6,439,734 B1 | * | 8/2002 | Lo | 362/118 |
| 6,491,408 B1 | * | 12/2002 | Cooper et al. | 362/184 |
| 6,523,969 B2 | * | 2/2003 | Yang et al. | 362/118 |

FOREIGN PATENT DOCUMENTS

| | | | | |
|---|---|---|---|---|
| JP | 07195890 A | * | 8/1995 | B43K/8/02 |
| JP | 3465333 B | | 11/2003 | |

* cited by examiner

*Primary Examiner*—Alan Cariaso
*Assistant Examiner*—Guiyoung Lee
(74) *Attorney, Agent, or Firm*—Gifford, Krass, Groh, Sprinkle, Anderson & Citkowski, P.C.

(57) ABSTRACT

An ultraviolet light emitting diode flashlight is contained within a housing having a pen tip extending from the housing and an ink or dye reservoir in fluid communication with the pen tip. The ultraviolet light emitting diode flashlight within the housing emits light capable of inducing fluorescence in the ink or dye. A switch assembly completes an electrical circuit between a light emitting diode and a battery to activate the flashlight. A writing system package includes at least two of: a neon or pastel colored writing surface, a security pen having an ink or dye that fluoresces in the visible portion of the light spectrum upon exposure to ultraviolet light, and an ultraviolet light emitting diode flashlight.

16 Claims, 2 Drawing Sheets

ULTRAVIOLET LIGHT WRITING SYSTEM

RELATED APPLICATION

This application claims priority of U.S. Provisional Patent Application No. 60/341,434 filed Dec. 14, 2001, which is incorporated herein by reference.

FIELD OF THE INVENTION

The present invention in general relates to a writing system, and in particular to a writing system containing an ink or dye that fluoresces in the visible portion of the light spectrum upon exposure to ultraviolet light.

BACKGROUND OF THE INVENTION

Invisible inks are part of the ancient science of steganography where hidden messages cannot be read by anyone other than the intended recipient, but also that no one else knows the message is even being sent. Invisible ink has been used since ancient times to produce steganographic writings. A variety of invisible ink substances have been known for centuries with varying success, including fruit juices and cobalt salts that could be developed and detected through heat or light. While invisible ink has largely been replaced as an espionage tool by cryptography, these materials are still used for security marking and amusement.

It is still the case, just as in ancient times, that writing with invisible ink involves an instrument separate from the visualization equipment. This separation is inconvenient during writing as intermediate visualization of the writing is impractical and there is a tendency to lose either the writing instrument or the visualization equipment. While a conventional security pen affords all the convenience of a visible writing instrument, ultraviolet and black light sources have remained inconveniently large to carry in conjunction of a conventional security marker. Thus, there exists a need for a writing system having a visualization element integrated with an invisible ink writing instrument.

SUMMARY OF THE INVENTION

The pen-light includes a housing with a pen tip extending therefrom. The pen tip is in fluid communication with an ink or dye reservoir containing an ink or dye that fluoresces in the visible portion of the light spectrum upon exposure to light having a wavelength of less than 405 nanometers. A light emitting diode having an emission wavelength of less than 405 nanometers is also within the housing. A battery within the housing forms a circuit with the light emitting diode upon engagement of a switch assembly. Alternatively, a writing system includes together in combination at least two of: a neon or pastel colored writing surface, a security pen containing an ink or dye that fluoresces in the visible portion of the light spectrum upon exposure to light having a wavelength of less than 420 nanometers, and a light emitting diode flashlight containing an ultraviolet light emitting diode. The light emitting diode flashlight is capable of being linked to the security pen.

DESCRIPTION OF THE PREFERRED EMBODIMENT

The present invention has utility as an invisible identification marking pen and reader therefor combined into a conveniently carried housing.

The present invention involves a pen containing a dye or ink visible under ultraviolet light contained in combination with an ultraviolet emitting light emitting diode (LED) within a housing.

Figure 1:
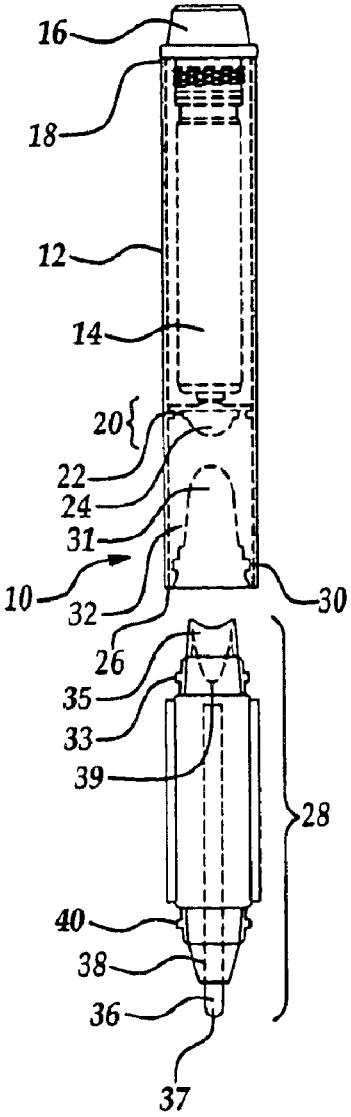
FIG. 1 is a partial cutaway plane view of an inventive combined security pen and ultraviolet light emitting diode.

In the embodiment depicted in FIG. 1, an inventive pen-light is shown generally at 10. The pen-light 10 has a battery holder 12 containing a battery 14. A switch 16, preferably having a locked "on" setting, fits in complementary securement to the distal terminus 18 of the battery holder 12. The battery 14 rests in electrical contact with an LED module 20 within the battery holder 12. The LED module 20 includes a battery contact 22, an LED 24, and optionally a voltage modifying circuit such that activation of the switch 16 completes an electrical circuit thereby illuminating the LED 24.

The battery 14 is any number of single or multiple batteries capable of illuminating the LED 24. The LED 24 emitting at least one wavelength less than 420 nanometers, and more preferably less than 405 nanometers. Battery voltages include 1.5 V, 2.4 V, 6V and 12V. Battery types appreciated to be operative herein illustratively include AAA, AA, Li, Ni Cd, and metal hydride. It is appreciated that a series configuration of batteries of lower voltage is operative to drive an LED of a higher threshold voltage.

The battery holder 12 has a proximal terminus 26 configured to selectively mate to a pen assembly 28. The battery holder 12 preferably has an LED emission translucent or transparent joinder portion 32 into which the female bayonet fitting 30 is integrated. More preferably, the joinder portion 32 is transparent. Still more preferably, the joinder portion 32 has a receptacle 34 shaped to form a lens 31 with a preselected lensing effect to emission from the LED 24. The lens 31 illustratively being concave, convex and torroidal. While the proximal terminus 26 is shown in FIG. 1 with a female bayonet fitting 30 adapted to receive a complementary male bayonet fitting 33 on the cap end 35 of the pen assembly 28, it is appreciated that other types of fittings are operative herein, illustratively including Luer, snap and threaded.

The pen assembly 28 is formed of translucent or transparent materials, as in the instance of the joinder portion 32. The pen assembly 28 contains a security ink refill 36 having a pen tip 37 held in place by a threaded barrel 38. The refill 36 contains an organic dye molecule or inorganic ink particulate conventional to the art that produces a visible light fluorescence upon ultraviolet stimulation. Such dyes and inks illustratively include conjugated organic rings systems and semiconductors in pure and doped forms having band gaps of greater than about 2.4 electron volts. The threaded barrel 38 having a set of male bayonet fittings 40 adapted to engage the female fitting 30. In the course of writing, male fitting 33 engages the joinder portion 32 exposing the pen tip 37. Activation of the LED 24 by engaging the switch 16 allows light to shine through the joinder portion 32 and the pen assembly 28 to illuminate the security ink releasing pen tip 37.

The cap end 35 of the pen assembly 28 is opposite the pen tip 37. The cap end 35 preferably is contoured to afford a lens 39 with preselected lensing effect to the light emission from the LED 24. When the inventive pen-light 10 is not actively writing, the pen assembly is reversed and male fitting 40 engages the female fitting 30 and the cap end 35 is terminal. Thus, in the capped configuration the LED is selectively illuminated to project light through the cap end 35 and onto, for instance, a security ink writing. Alternatively, it is appreciated that the pen assembly 28 is disengaged from the battery housing 12 and the battery housing 12 operates remote from the pen assembly 28 as a flashlight.

Figure 2:
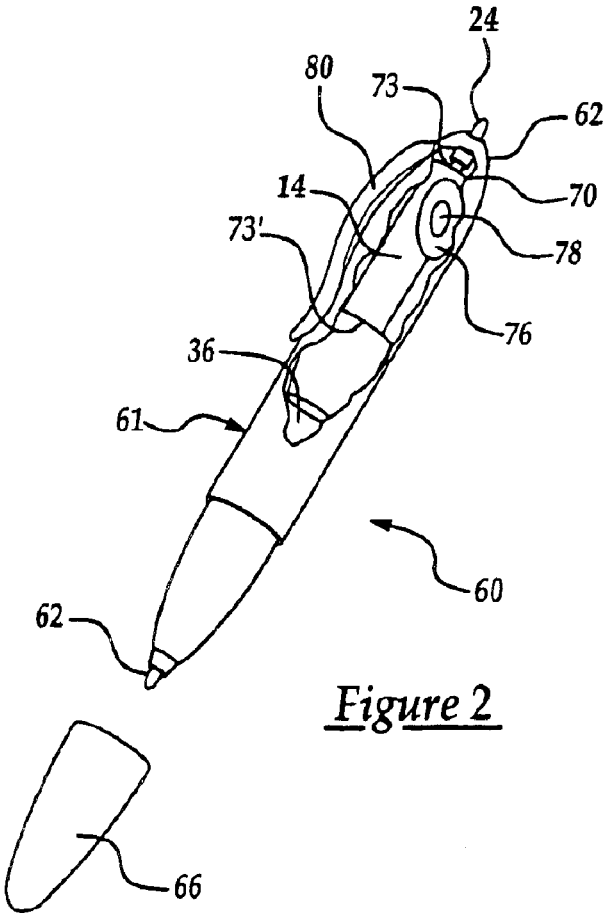
FIG. 2 is a partial cutaway view of an alternative embodiment of the invention depicted in FIG. 1.

In the embodiment depicted in FIG. 2, an inventive pen-light is shown generally at 60 where like numerals correspond to those of FIG. 1. The pen-light 60 has a housing 61 that terminates in a pen tip 62 in fluid communication with an ink refill 36. The housing 60 is constructed of conventional pen housing materials illustratively including plastics, metal and curable resins. Optionally, a pen cap 66 is provided to removeably cover the pen tip 62 and thereby prevent unintended discharge or drying of the pen tip 62. The opposite end of the housing 61 terminates in an LED 24. The LED 24 has leads 70 that extend from the LED base 62 and engage opposite terminals 73 and 73' of a battery 14 enclosed within the housing 61. Intermediate between the terminals 73 and 73' and the leads 70 is a pressure switch assembly 76, such that only upon depressing a button 78 of the switch assembly 76 a circuit completed between the LED 24 and the battery 14. Optionally, the pen-light 60 has a clip 80 proximal to the LED 24 to facilitate attachment to an article of clothing or paper. A UV LED flashlight assembly operative herein is detailed in U.S. Pat. No. 6,299,328.

Figure 3:
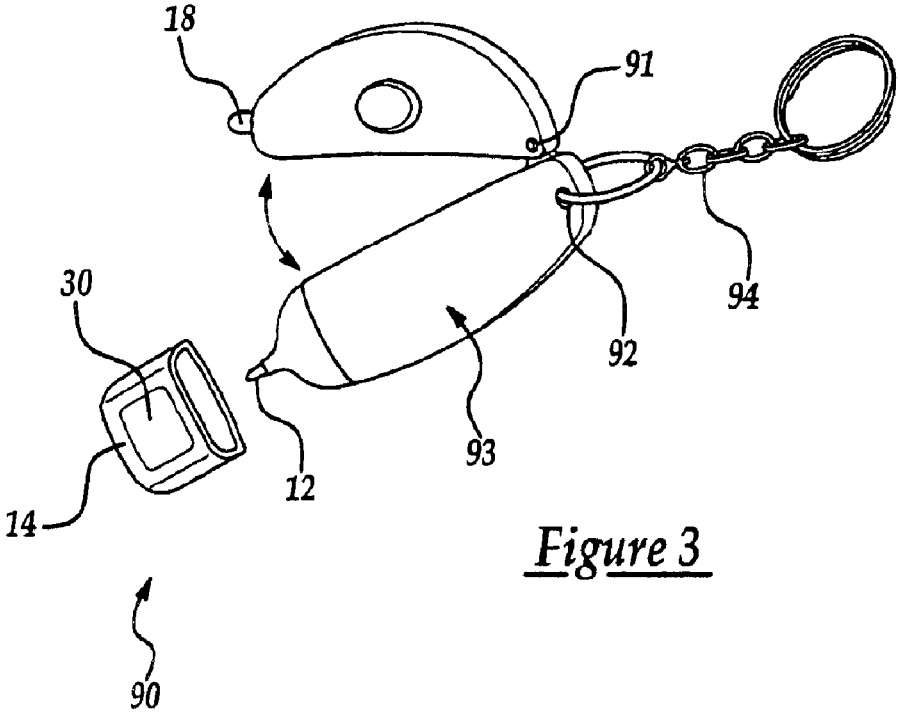
FIG. 3 is a perspective view of still another alternate embodiment of the invention depicted in FIG. 1.

An alternate inventive embodiment of FIG. 3 shows generally at 90 a foldable UV pen-light about a hinge 91, where like numerals as compared with FIGS. 1 and 2 are used for the same components. The foldable pen-light 90 is particularly well suited for instances were a compact pen-light is useful. Optionally, the pen-light 90 has an aperture 92 for the attachment of a key chain 94. It is appreciated that an ergonomic contour is designed into the housing 93 to facilitate ease of handling. In still another embodiment, the division between the light and pen portions of 90 is removed, along with the hinge, resulting in a unified housing containing both the pen and LED functions (not shown) in a footprint amenable for use as a key chain fob.

Figure 4:
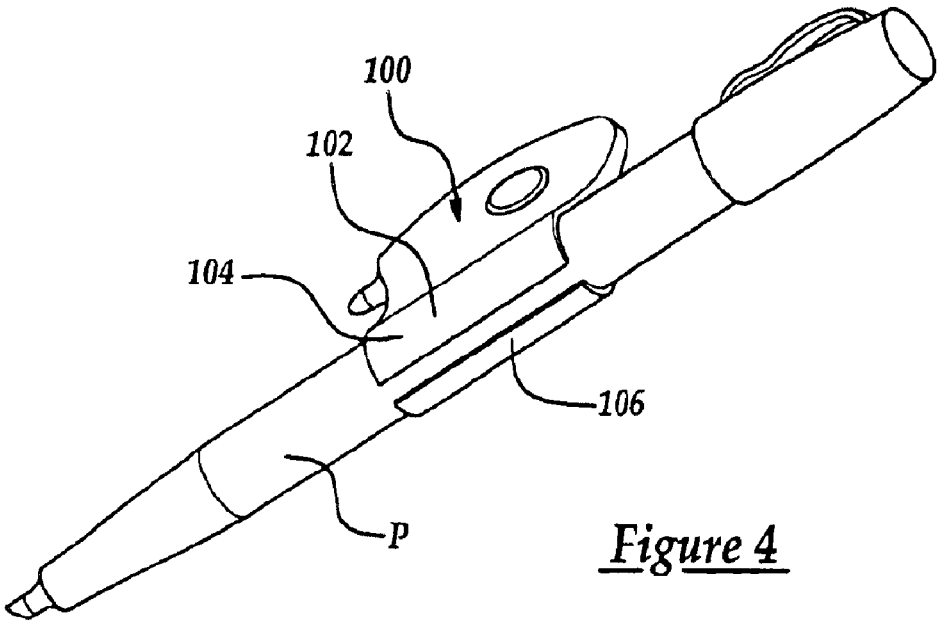
FIG. 4 is a perspective view of an ultraviolet light emitting diode flashlight adapted to engage a conventional security marking pen.
Figure 1:
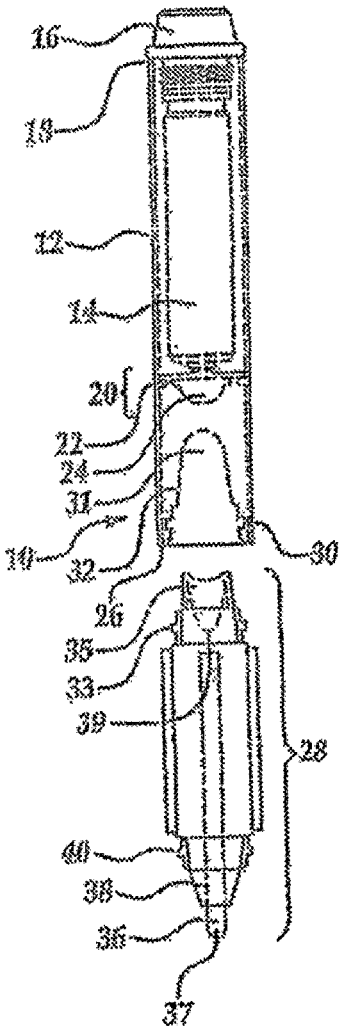
Figure 1A:
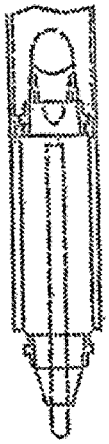
Figure 1B:
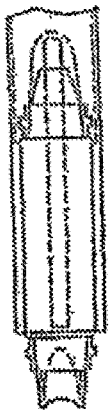
Figure 2:
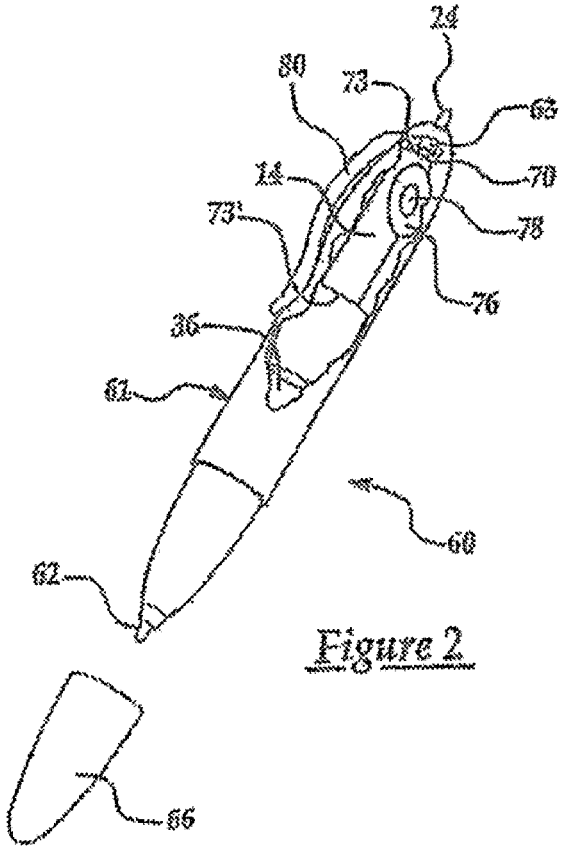

In still another embodiment, an ultraviolet flashlight housing 100 has integral therewith or attached thereto a clip 102 adapted to engage a conventional security marking pen P, as shown in FIG. 4. A UV flashlight clip 102 has opposing curved clamping members 104 and 106. The clamping members 104 and 106 are preferably formed of a resilient plastic or metal. The clamping members 104 and 106 are formed to exert a compressive force upon an outer pen diameter inserted therebetween. Spring steel and shock resistant thermoplastics are specific materials from which such clamping members are readily formed. Alternatively, the clamping members 104 and 106 are formed of a rubbery elastomeric material and joined to form a tube or cup sized to friction fit onto a conventional pen housing or a mateable pen cap provided with the pen (not shown). The clamping members 104 and 106 are positioned relative to the UV flashlight housing such that upon coupling the flashlight to the pen or pen cap, the light output from the flashlight projects generally in the same direction as the pen tip. Illumination in the general vicinity of the pen tip allows one to utilize a conventional security pen to write with the applied ink being visible during the writing process. It is appreciated that a UV LED flashlight and a conventional security pen are also coupled with a connecting fastener therebetween to assure the objects remain in proximity. A connecting fastener operative herein illustratively includes a ring, a chain, and pressure adhesive tape.

An inventive commercial package includes at least two of the following items: pastel or neon colored writing surface, a handheld flashlight emitting a wavelength of less than 420 nanometers, and a security marking pen. The writing surface illustratively including fiber and synthetic polymer based planar sheeting, such as paper, boards, and objects coated therewith. It is believed that optical brightening agents absorb ultraviolet and emit blue fluorescence that obscures similar wavelength fluorescence associated with conventional security inks or dyes. As a result, in embodiments where high contrast is desired between the security writing and the substrate, the substrate is preferably independent of optical brightening agents such as stilbene based compounds exemplified by LEUCOPHOR® products. Conversely, the presence of an optical brightening agent tends to decrease the security writing contrast. It has been surprisingly discovered that pastel and neon colorants associated with dying a writing substrate modify the appearance and fluorescence lifetime of the security pen dye, as compared to the same security pen dye applied to whitened or unbleached substrate. The changes in security dye fluorescence characteristics on pastel or neon substrates can render such writings at least partially obscured upon illumination with other conventional light sources used to image security dye. Specifically, security dye markings rendered on pastel or neon writing substrate are significantly obscured when viewed with a black light. As a result, a user of an inventive commercial package is afforded an added degree of security relative to unintended examination with the most common security dye imaging light source. This property of an inventive commercial package is particularly well suited for incorporation into a diary, personal journal, or private communication board.

A second possible component in a commercial package is a pen containing security dye that is essentially invisible under natural light conditions. The advantage of a security marker and the above detailed pastel or neon writing substrate lies in being readable with a narrower class of non-visible light sources than is common.

Alternatively, a commercial package includes the aforementioned violet or ultraviolet light emitting LED flashlight and a security pen. The LED flashlight and security pen are appreciated to be operative as wholly separated components even though in a preferred embodiment the flashlight and pen are conjugated by a storage case, a securement ring, or similar conventional means of retaining a flashlight in proximity to a security marker. Preferably, the marker and flashlight are linked together as detailed above.

A commercial package according to the present invention is typically packaged in a blister pack. The commercial packaging in addition to containing at least two of: neon or pastel writing substrate, a pen containing security dye and an ultraviolet emitting LED flashlight also contains instructions as to the use of the various components and in the case of the flashlight instructions to replace expendable LED and battery components.

Patents and publications mentioned in the specification are indicative of the levels of those skilled in the art to which the invention pertains. These patents and publications are incorporated herein by reference to the same extent as if each individual patent or publication was explicitly and individually incorporated herein by reference.

One skilled in the art will readily appreciate that the present invention is described herein with specific examples representative of preferred embodiments. Changes with respect to the present invention and other uses therefor will occur to those skilled in the art. These changes are encompassed within the spirit of the invention as defined by the scope of the appended claims.

What is claimed is:

1. A pen-light comprising:

a battery holder having a distal terminus and proximal terminus;

a battery within said holder;

a switch;

a light emitting diode module within said holder, said module selectively forming an electrical circuit with said battery and said switch, said light emitting diode emitting a wavelength of less than 420 nanometers;

a pen assembly having a cap end and a pen tip end, said pen assembly mateably attachable to said battery holder via both the cap end and pen tip end; and an ink or dye refill in fluid communication with a pen tip extending from the pen tip end and fluorescing in the visible portion of the light spectrum upon exposure to light having a wavelength of less than 420 nanometers.

2. The pen-light of claim 1 further comprising a joinder portion adjacent to the proximal terminus of said holder.

3. The pen-light of claim 2 wherein said joinder is transparent or translucent.

4. The pen-light of claim 2 wherein said joinder mateably attaches to said pen assembly.

5. The pen-light of claim 2 wherein said joinder has a pen assembly receptacle conning a joinder lens.

6. The pen-light of claim 4 wherein said joinder attaches to said pen assembly through a set of fittings selected from the group consisting of: bayonet, snap and threaded.

7. The pen-light of claim 1 wherein said pen assembly is transparent or translucent.

8. The pen-light of claim 1 wherein said cap end of said pen assembly is contoured to form a cap end lens.

9. A pen-light comprising:

a housing;

an pen tip extending from said housing;

an ink or dye refill in fluid communication with said pen tip, said refill containing an ink or dye that fluoresces in the visible portion of the light spectrum upon exposure to light having a wavelength of less than 420 nanometers;

a light emitting diode within said housing emitting at least one wavelength less than 420 nanometers and emitting light onto said pen tip;

a battery within said housing; and a switch assembly completing an electrical circuit between said light emitting diode and said battery upon engagement thereof.

10. The pen-light of claim 9 further comprising a key chain attached to said housing.

11. The pen-light of claim 9 further comprising a hinge intermediate between said light emitting diode and said pen tip about which said housing is foldable.

12. The pen-light of claim 11 further comprising a key chain attached to said housing.

13. The pen-light of claim 9 further comprising a lens in said housing and intermediate between said pen tip and said light emitting diode.

14. The pen-light of claim 13 wherein said housing is transparent proximal to said pen tip.

15. An improved writing system including a writing surface, a pen containing an ink or dye with visible light fluorescence upon exposure to a light wavelength shorter than that of the ink or dye visible fluorescence and a handheld light source that emits a wavelength stimulating visible fluorescence in the ink or dye applied to the writing surface, wherein the improvement lies in the pen and light source being integrated into a penlight comprising;

a battery holder having a distal terminus and proximal terminus;

a battery within said holder;

a switch;

a light emitting diode module within said holder, said module selectively forming an electrical circuit with said battery and said switch, said light emitting diode emitting a wavelength of less than 420 nanometers;

a pen assembly having a cap end and a pen tip end, said pen assembly mateably attachable to said battery holder via both the cap end and pen tip end; and an ink or dye refill in fluid communication with a pen tip extending from the pen tip end and fluorescing in the visible portion of the light spectrum upon exposure to light having a wavelength of less than 420 nanometers.

16. A pen-light comprising:

a housing;

an pen tip extending from said housing;

an ink or dye refill in fluid communication with said pen tip, said refill containing an ink or dye that fluoresces in the visible portion of the light spectrum upon exposure to light having a wavelength of less than 420 nanometers;

a light emitting diode within said housing emitting at least one wavelength less than 420 nanometers;

a battery within said housing; and a switch assembly completing an electrical circuit between said light emitting diode and said battery upon engagement thereof;

wherein said pen tip and said light emitting diode extend from opposing ends of said housing.

* * * * *

UNITED STATES PATENT AND TRADEMARK OFFICE

CERTIFICATE OF CORRECTION

PATENT NO. : 6,860,616 B2
DATED : March 1, 2005
INVENTOR(S) : Sun Yu et al.

It is certified that error appears in the above-identified patent and that said Letters Patent is hereby corrected as shown below:

Column 5,
Line 33, “conning” should be changed to -- forming --.

Signed and Sealed this

Twelfth Day of July, 2005

JON W. DUDAS
*Director of the United States Patent and Trademark Office*

UNITED STATES PATENT AND TRADEMARK OFFICE

CERTIFICATE OF CORRECTION

PATENT NO. : 6,860,616 B2
APPLICATION NO. : 10/264993
DATED : March 1, 2005
INVENTOR(S) : Sun Yu It is certified that error appears in the above-identified patent and that said Letters Patent is hereby corrected as shown below:

The Title Page, showing an illustrative figure, should be deleted and substitute therefor the attached title page.

Figure 1A:
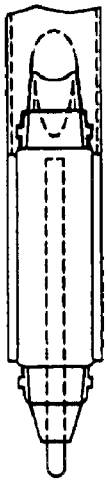
Figure 1B:
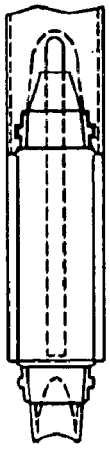

Delete drawings sheet 1-2 and substitute therefor the drawing sheets, consisting of figs. 1A-2 as shown on the attached page.

Signed and Sealed this

Twenty-ninth Day of May, 2007

JON W. DUDAS
*Director of the United States Patent and Trademark Office*

(12) United States Patent
Yu et al.

(10) Patent No.: US 6,860,616 B2
(45) Date of Patent: Mar. 1, 2005

(54) ULTRAVIOLET LIGHT WRITING SYSTEM

(75) Inventors: Sun Yu, Berkley, MI (US); Andrew Tiefel, South Lyon, MI (US); David Perrin, Troy, MI (US)

(73) Assignee: IQ Hong Kong, Ltd., Tsuen Wan (HK)

( * ) Notice: Subject to any disclaimer, the term of this patent is extended or adjusted under 35 U.S.C. 154(b) by 58 days.

(21) Appl. No.: 10/264,993

(22) Filed: Oct. 4, 2002

(65) Prior Publication Data

US 2003/0112623 A1 Jun. 19, 2003

Related U.S. Application Data

(60) Provisional application No. 60/341,434, filed on Dec. 14, 2001.

(51) Int. Cl.[7] ..... B43K 29/10

(52) U.S. Cl. ..... 362/118; 362/84; 362/579; 362/800

(58) Field of Search ..... 362/118, 84, 99, 362/116, 120, 396, 194, 800, 579

(56) References Cited

U.S. PATENT DOCUMENTS

| | | | | |
|---|---|---|---|---|
| 2,663,791 | A | 12/1953 | Hettrick | 240/6.46 |
| 2,811,632 | A | 10/1957 | Bartlett | 240/6.46 |
| 3,045,111 | A | 7/1962 | Hoenig | 240/6.46 |
| 3,303,337 | A | 2/1967 | Lo | 240/6.46 |
| 4,016,414 | A | 4/1977 | Browning et al. | 240/6.46 |
| 4,890,204 | A | 12/1989 | Lin et al. | 362/118 |
| 5,131,775 | A | 7/1992 | Chen | 401/195 |
| 5,448,459 | A * | 9/1995 | Rogers | 362/191 |
| 5,673,996 | A | 10/1997 | Ducker | 362/118 |
| 6,099,185 | A | 8/2000 | Huang et al. | 401/195 |
| 6,164,856 | A | 12/2000 | Lo | 401/52 |
| 6,439,734 | B1 * | 8/2002 | Lo | 362/118 |
| 6,491,408 | B1 * | 12/2002 | Cooper et al. | 362/184 |
| 6,523,969 | B2 * | 2/2003 | Yang et al. | 362/118 |

FOREIGN PATENT DOCUMENTS

| | | | |
|---|---|---|---|
| JP | 07195890 A * | 8/1995 | B43K/8/02 |
| JP | 3465333 B | 11/2003 | |

* cited by examiner

*Primary Examiner*—Alan Cariaso
*Assistant Examiner*—Guiyoung Lee
(74) *Attorney, Agent, or Firm*—Gifford, Krass, Groh, Sprinkle, Anderson & Citkowski, P.C.

(57) ABSTRACT

An ultraviolet light emitting diode flashlight is contained within a housing having a pen tip extending from the housing and an ink or dye reservoir in fluid communication with the pen tip. The ultraviolet light emitting diode flashlight within the housing emits light capable of inducing fluorescence in the ink or dye. A switch assembly completes an electrical circuit between a light emitting diode and a battery to activate the flashlight. A writing system package includes at least two of: a neon or pastel colored writing surface, a security pen having an ink or dye that fluoresces in the visible portion of the light spectrum upon exposure to ultraviolet light, and an ultraviolet light emitting diode flashlight.

16 Claims, 2 Drawing Sheets

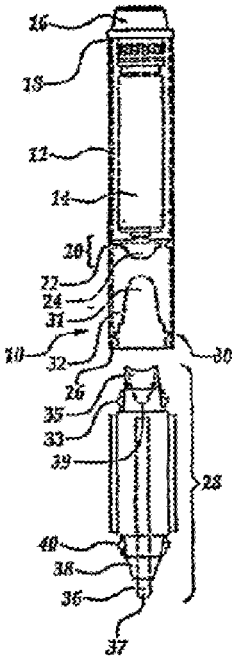

1/2